US007662056B1

(12) United States Patent
Lin et al.

(10) Patent No.: US 7,662,056 B1
(45) Date of Patent: Feb. 16, 2010

(54) RACKET STRINGING MACHINE

(76) Inventors: Po-Hsiu Lin, No. 1, Lane 96, Dongshun St., Shulin City, Taipei County, 238 (TW); Chun-Chieh Li, No. 1, Lane 96, Dongshun St., Shulin City, Taipei County, 238 (TW)

( * ) Notice: Subject to any disclaimer, the term of this patent is extended or adjusted under 35 U.S.C. 154(b) by 0 days.

(21) Appl. No.: 12/274,419

(22) Filed: Nov. 20, 2008

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,348,024 A * 9/1982 Balaban ..... 473/556
5,820,500 A * 10/1998 Raos ..... 473/557
7,455,604 B2 * 11/2008 Li ..... 473/557
2008/0167147 A1 * 7/2008 Li ..... 473/557
2008/0242454 A1 * 10/2008 Li ..... 473/556

* cited by examiner

*Primary Examiner*—Raleigh W. Chiu
(74) *Attorney, Agent, or Firm*—Alan Kamrath; Kamrath & Associates PA

(57) ABSTRACT

A racket stringing machine comprises includes a horizontal adjustment device and a brake device. The adjustment device is fixed to a base by a horizontal mounting seat which includes a horizontal rail and a base plate with one end slidably mounted to the rail. Thus, the string pulling device can be horizontally moved to adjust the angle of the string relative to the racket, so as to eliminate the friction between the string and the racket, improving the stringing quality and extending life of the racket frame. The brake device includes a disc and a clamping device disposed on a rotary shaft of the base. The clamping device is connected to hand and foot switches by two brake cables. When the operator leaves or stops the machine for a while during a stringing operation, he can stop the stringing operation conveniently by using the hand or foot switch.

6 Claims, 8 Drawing Sheets

RACKET STRINGING MACHINE

BACKGROUND OF THE INVENTION

1. Field of the Invention

The present invention relates to a racket stringing machine and, more particularly, to a racket stringing machine which is provided with a horizontal adjustment device capable of improving stringing quality by adjusting the left and right positions of the string pulling device and a brake device allowing the operator to leave or stop the stringing machine for a while during the stringing operation.

2. Description of the Prior Art

Referring to FIG. 1, a conventional racket stringing machine is shown and comprises a base a, a frame retainer b and a string pulling device c. The frame retainer b is pivotal upon a rotary shaft in the top of the base a and can be rotated and positioned thereon. The string pulling device c includes a pulling member c1 and a rotary member c2 and is connected to the base a via a horizontal plate 10 located at the top of the base a. The horizontal plate 10 is provided with a ratchet 101 along which the string pulling device c moves, namely, the string pulling device c is movable along the horizontal plate 10.

In operation, as shown in FIG. 2, a racket frame d is retained on the frame retainer b. The string e is then fixed between the pulling member c1 of the string pulling device c and the racket frame d of the racket. After that, a desired string tension value is set, and rotating the rotary member c2 can adjust the string tension of the string e to the desired value. By repeating the above operation, the lengthwise and transverse strings e can be strung to the racket frame d, respectively.

Although it can perform the stringing operation automatically and conveniently, this racket stringing machine still has the following disadvantages:

1) the horizontal plate 10 and the string pulling device c are fixed at the same position without being able to move, and the strings e must be pulled one by one. Hence, from a top view, there can be seen an angle θ between the outer periphery of the racket frame d of the racket and the strings e, and this angle still exists even after the racket frame d of the racket rotates. Therefore, during the stringing operation, the force distribution on the racket frame d of the racket is non-uniform, resulting in an inaccurate tension of the strings e. On top of that, there will be friction between the inserting holes of the racket frame d of the racket and the strings e, which will probably damage or even break the strings e. Even if the strings e are not broken after stringing, the structure of the racket frame d of the racket will be adversely affected. It greatly reduces the life of the racket and the strings e. Furthermore, the imprecise string tension may affect the performance of the player using the racket.

2) this racket stringing machine should be operated by an operator on the spot, and during operation, the operator may have something urgent to deal with and have to leave for a while. However, once the stringing process begins, the racket stringing machine must keep running continuously until the stringing of the whole racket is done. Otherwise, the strings e in the process of being pulled through the racket frame d of the racket will loosen once the stringing machine is turned off. After the stringing machine starts running again and after it finishes the stringing operation, the strings e will be loose, and the racket cannot be used, so the stringing operation must be started all over again. Thus, it is quite time consuming.

The present invention has arisen to mitigate and/or obviate the afore-described disadvantages.

SUMMARY OF THE INVENTION

The primary object of the present invention is to provide a racket stringing machine, wherein the string pulling device can be moved left and right along with the base plate during a stringing operation to adjust the string between the frame of the racket and the string pulling device to be in line with the base plate, such that it not only protects the racket frame but also extends the life of the racket.

Another object of the present invention is to provide a racket stringing machine, wherein the brake device on the base can temporarily stop the racket stringing machine, and the clamping device can clamp the disc. Thus, when the operator leaves or stops the machine for a while if something comes up during a stringing operation, he can stop the stringing operation conveniently by using the brake device without having the problem of the string loosening.

To achieve the above object, the improvement of the racket stringing machine in accordance with the present invention involves a horizontal adjustment device and a brake device.

The horizontal adjustment device is fixed to the base of the racket stringing machine by a horizontal mounting seat which includes a horizontal rail and a base plate with one end slidably attached to the rail. By such arrangements, the string pulling device can be moved left and right along with the base plate during the stringing operation to adjust the string between the frame of the racket and the string pulling device to be in line with the base plate, so as to prevent the string from damaging or wearing off the racket frame, thus improving the stringing quality and extending life of the racket frame.

The brake device comprises a disc and a clamping device which are disposed on a top of a rotary shaft of the base. The clamping device is connected to a hand switch and a foot switch by two brake cables. Thus, when the operator leaves or stops the machine for a while if something comes up during a stringing operation, he can stop the stringing operation conveniently by using the hand switch or foot switch.

DETAILED DESCRIPTION OF THE PREFERRED EMBODIMENTS

The present invention will be clearer from the following description when viewed together with the accompanying drawings, which show, for purpose of illustration only, the preferred embodiment in accordance with the present invention.

Figure 1:
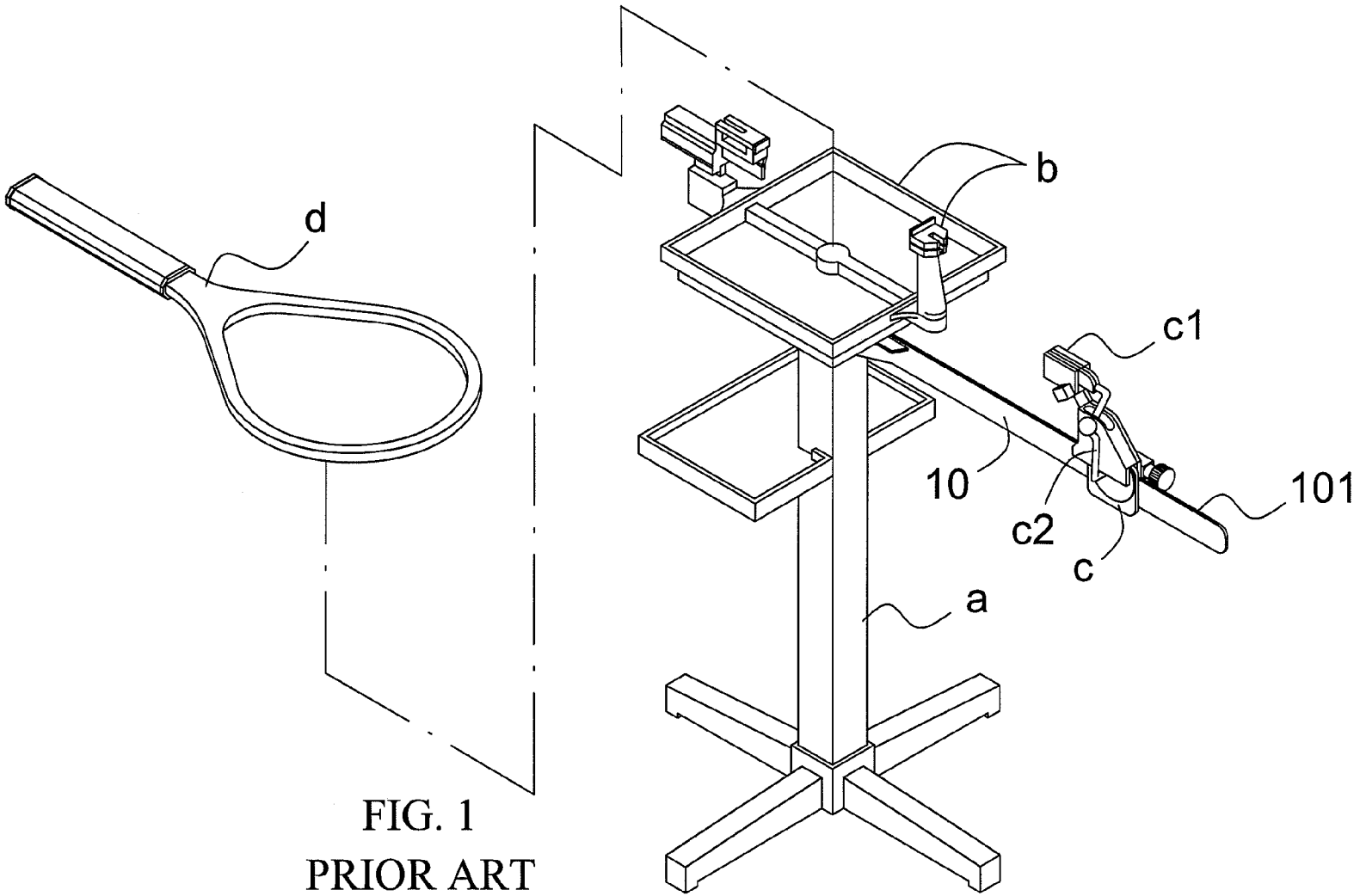
FIG. 1 PRIOR ART
FIG. 1 shows a conventional racket stringing machine.
Figure 2:
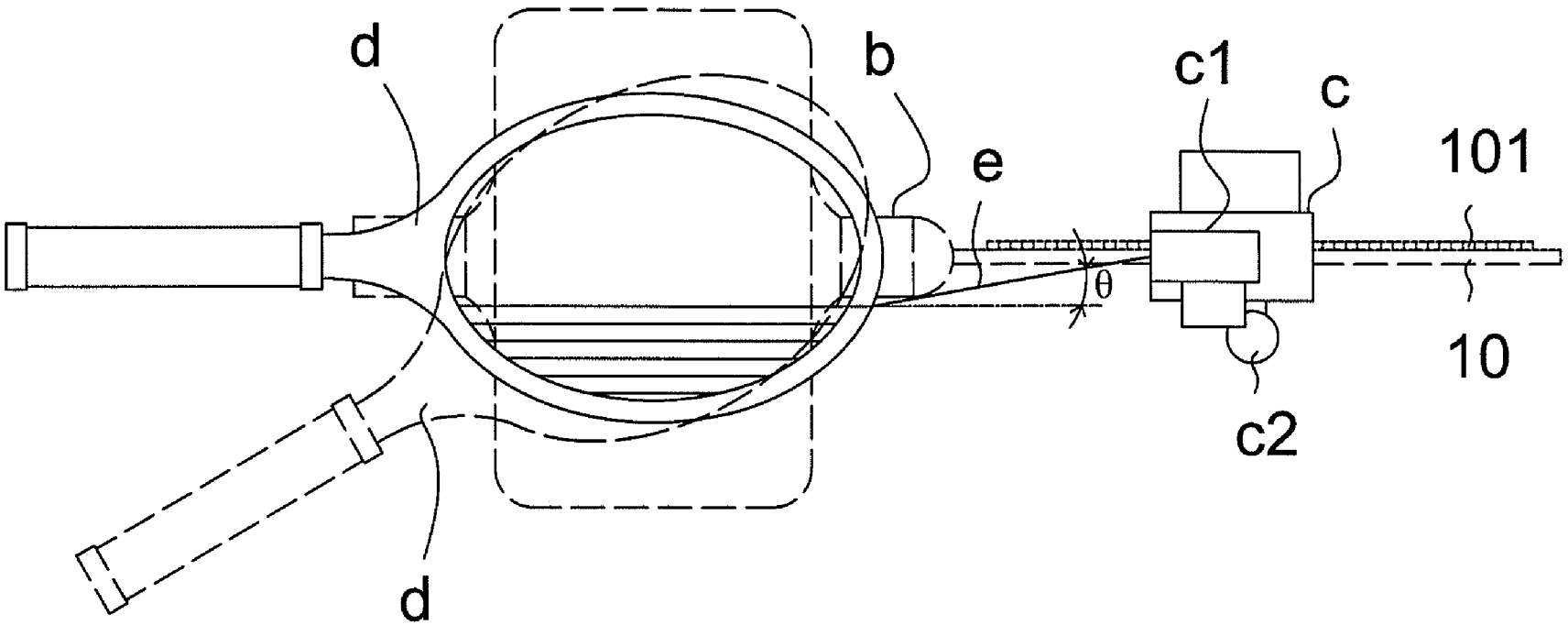
FIG. 2 PRIOR ART
FIG. 2 shows a conventional racket stringing machine, wherein there is an angle shown between the string and the periphery of the racket frame d of the racket.
Figure 3:
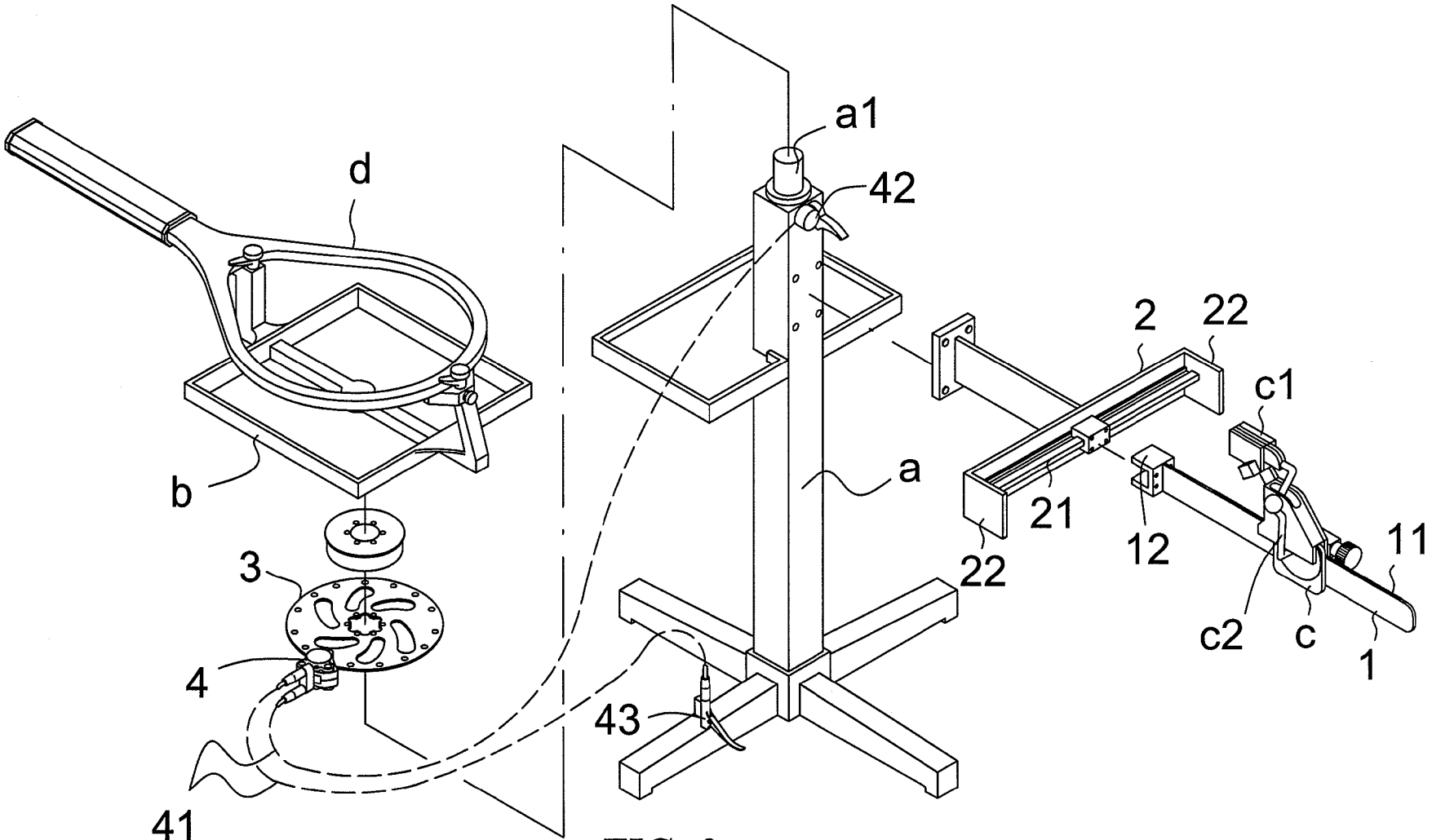
FIG. 3 is an exploded view of a racket stringing machine in accordance with the present invention.

Referring to FIG. 3, an improved racket stringing machine is shown, and its improvement involves a horizontal adjustment device and a brake device. The horizontal adjustment device comprises a base plate 1 and a mounting seat 2. The racket stringing machine comprises a base a, a frame retainer b and a string pulling device c (these parts are the same as the conventional structures, therefore further explanation is omitted). The string pulling device c includes a pulling member c1 and a rotary member c2.

The base plate 1 is horizontally arranged, and the string pulling device c is assembled on the base plate 1. On the base plate 1 is further disposed a ratchet 11 along which the string pulling device c is able to move. At one end of the base plate 1 is mounted a horizontal slide seat 12 which is C-shaped in cross section.

The mounting seat 2 is a horizontally arranged structure fixed to the top of the base a and includes a horizontal rail 21. The base plate 1 is mounted to the rail 21 by the slide seat 12 and is capable of moving right and left along the rail 21. The mounting seat 2 includes two opposite lateral boards 22 for positioning the rail 21 so that the slide seat 12 is movable along the rail 21 and restricted between the two lateral boards 22.

Figure 4:
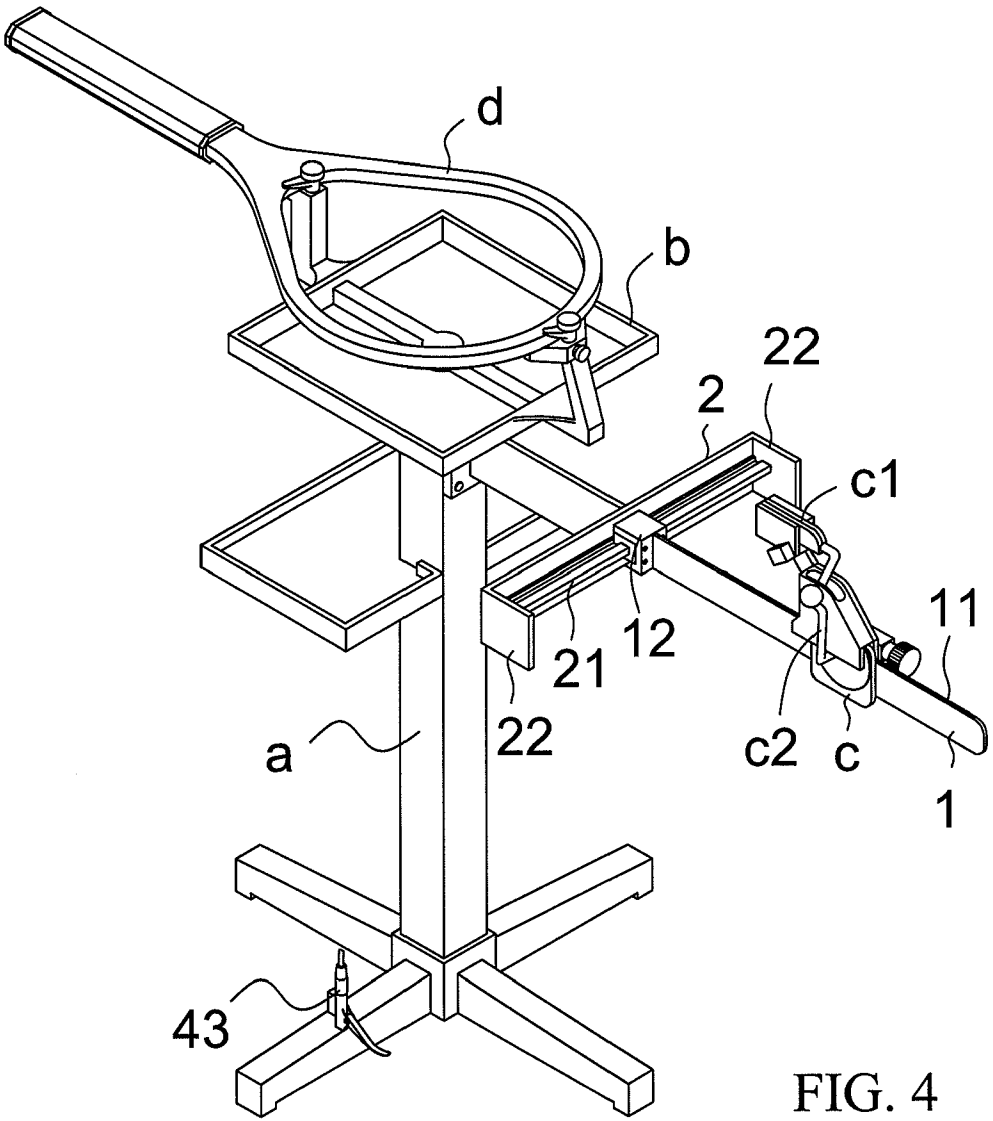
FIG. 4 is an assembly view of the racket stringing machine in accordance with the present invention.

As shown in FIG. 4, in operation, a racket frame d of a racket is retained on the frame retainer b. The string e is positioned between the string pulling member c1 and the racket frame d of the racket. Following setting the string tension value, rotating the rotary member c2 can adjust the string tension of the string e to the desired value. By repeating the above operation, the lengthwise and transverse strings e can be strung to the racket frame d, respectively.

Figure 5:
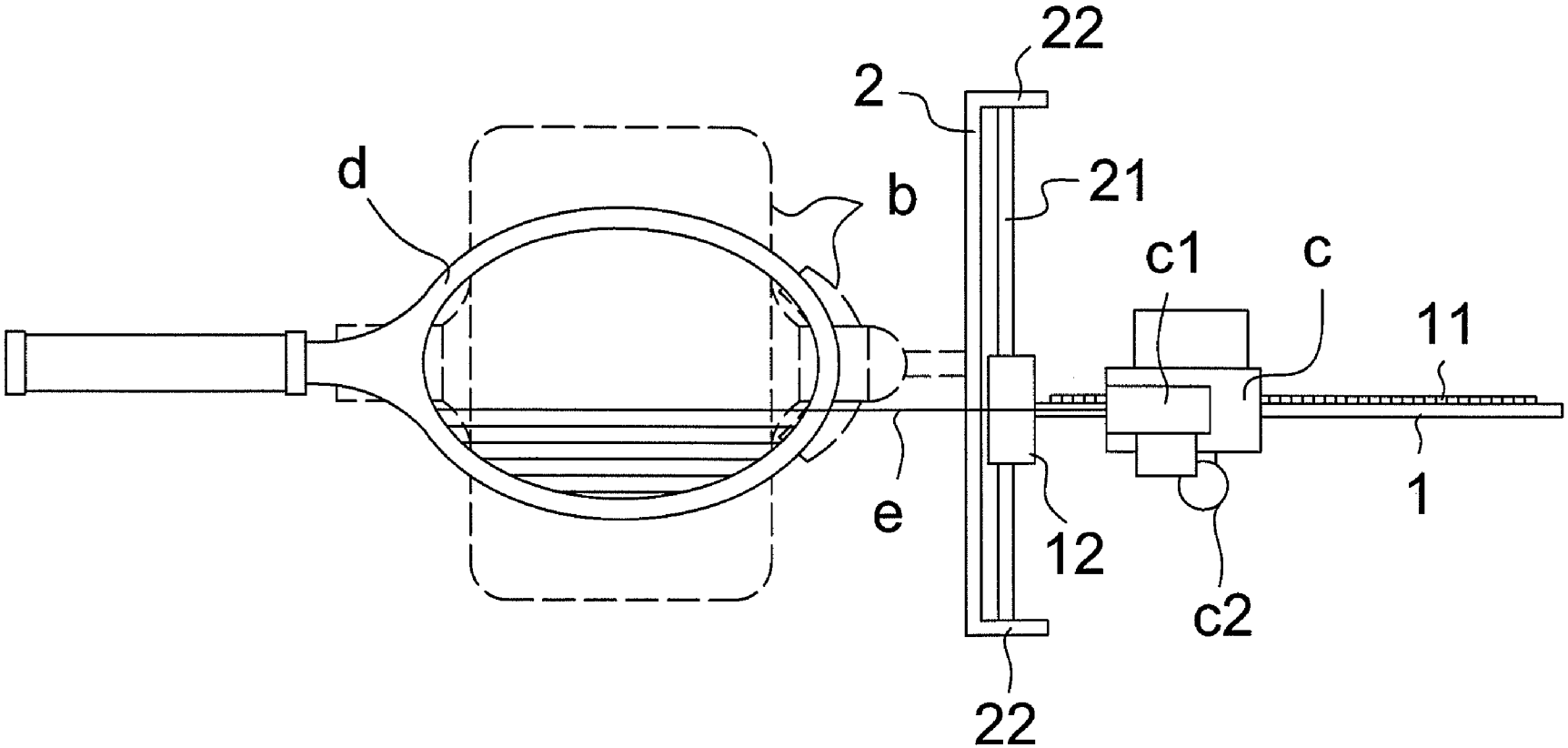
FIG. 5 is a top view of the racket stringing machine in accordance with the present invention.
Figure 6:
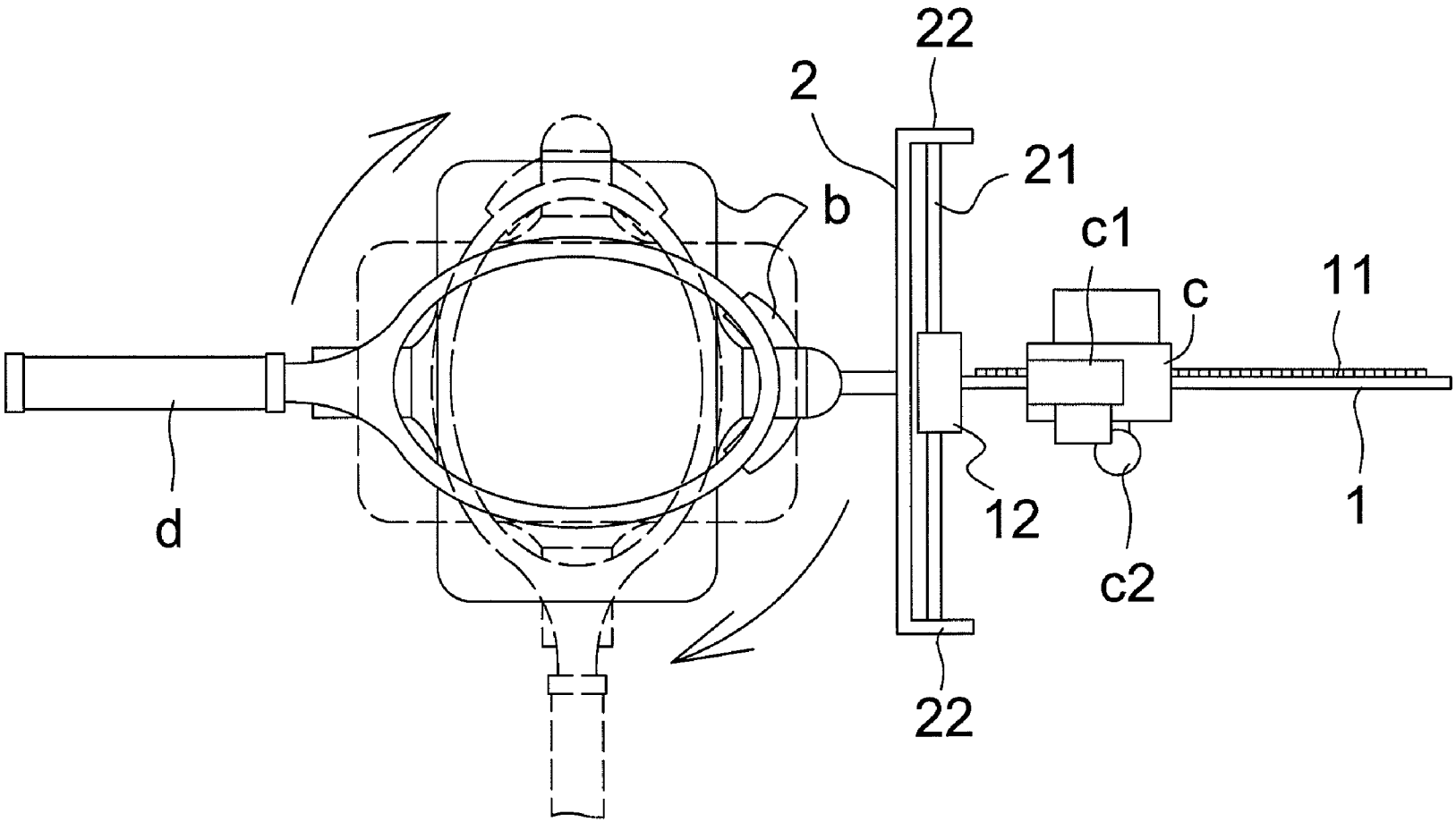
FIG. 6 is an operational view of the racket stringing machine in accordance with the present invention.
Figure 7:
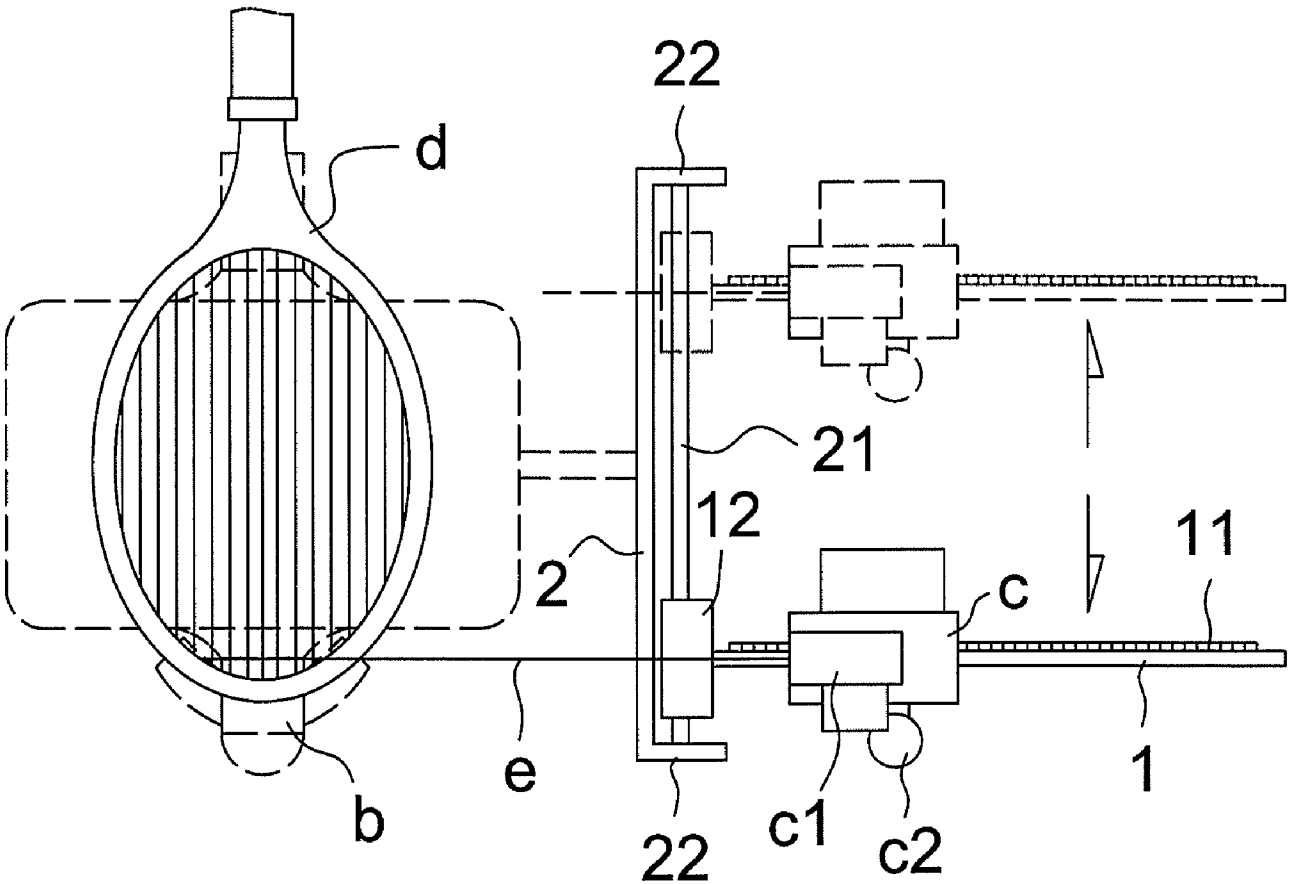
FIG. 7 is another operational view of the racket stringing machine in accordance with the present invention.

The principle characteristic of the present invention is such that, as shown in FIGS. 5, 6 and 7, during the process of stringing the string e to the racket frame d of the racket or after the racket frame d rotates, there will be an angle between the string e and the periphery of the racket frame d of the racket. At this moment and since the slide seat 12 can slide horizontally left and right along the rail 21 to the position where the string e is in line with the base plate 1, the angle disappears, so that the stringing operation is kept in its best state.

Figure 8:
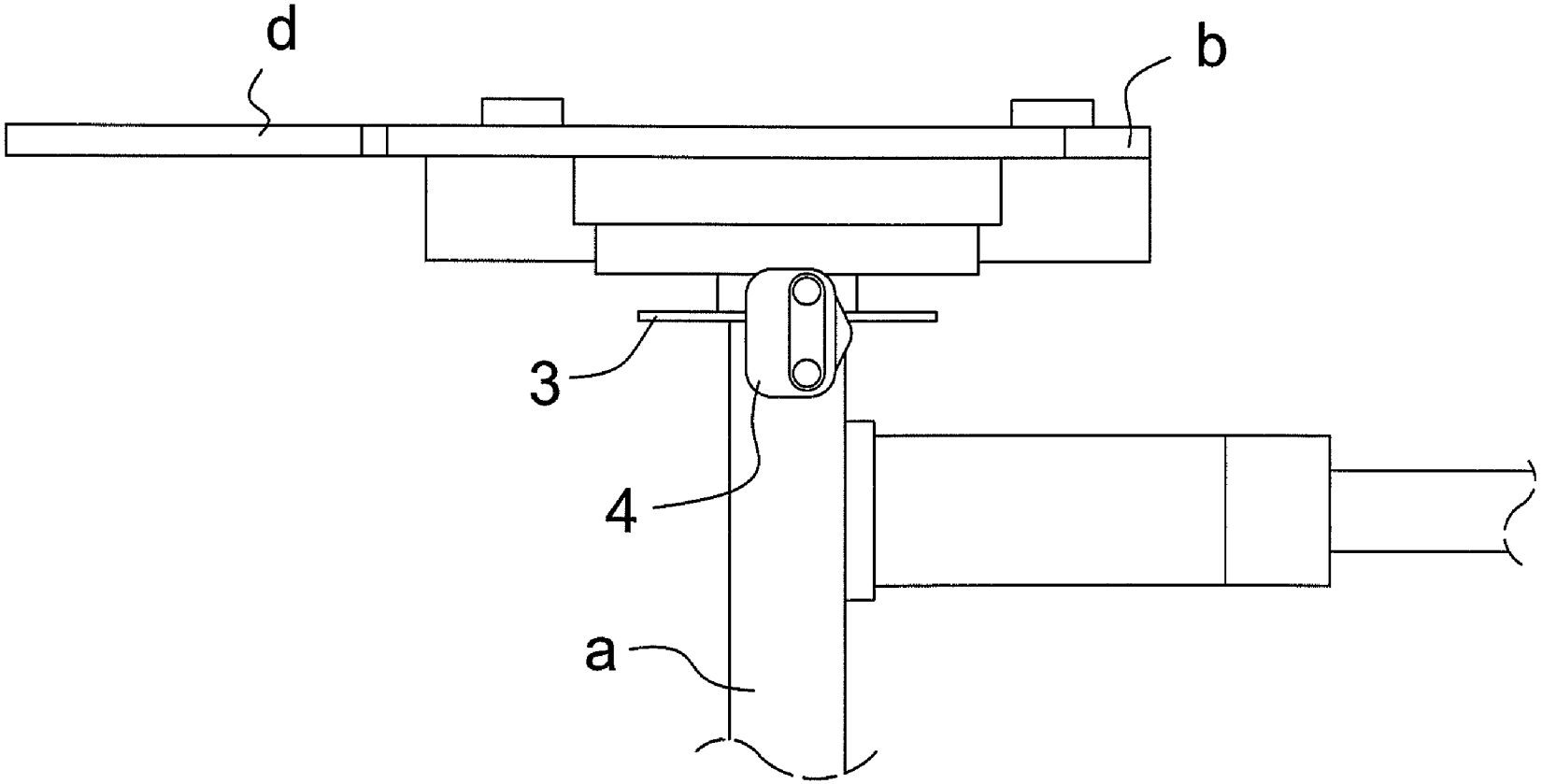
FIG. 8 shows the brake device on the racket stringing machine in accordance with the present invention.

As shown in FIGS. 3 and 8, the brake device of the present invention comprises a disc 3 and a clamping device 4 which are disposed on the top of a rotary shaft a1 of the base a under the frame retainer. The disc 3 is fixed to the rotary shaft a1. The clamping device 4 includes a notch for receiving the disc 3 and is connected with two brake cables 41, one of which extends to a hand switch 42 on the top of the base a and the other is connected to the foot switch 43 under the base a. By such arrangements, when the operator leaves or stops the machine for a while if something comes up during a stringing operation, he can stop the stringing operation conveniently by using the hand switch 42 or foot switch 43.

It is apparent from the above description that the present invention has the following advantages:

1) The string pulling device c can be moved during a stringing operation to adjust the string e between the frame of the racket and the string pulling device c to be in line with the base plate 1, namely, there will be no angle between the racket frame and the strings e, so as to prevent the string e from touching the periphery of the inserting holes of the racket frame. Thus, there will be no friction between the racket frame of the racket and the string, so as to keep the stringing operation in its best state. Further, it ensures precise string tension without damaging the strings e and the racket frame as well, thus extending the life of the racket.

2) Since the brake device on the base can stop the racket stringing machine, the clamping device 4 can clamp the discs. Further, it is also provided with a hand switch 42 and a foot switch 43. Thus, when the operator leaves or stops the machine for a while if something comes up during a stringing operation, he can stop the stringing operation conveniently by using the hand switch 42 or foot switch 43.

While we have shown and described various embodiments in accordance with the present invention, it is clear to those skilled in the art that further embodiments may be made without departing from the scope of the present invention.

What is claimed is:

1. A racket stringing machine comprising a horizontal adjustment device and a base, with the horizontal adjustment device comprising a base plate and a string pulling device movably assembled on the base plate;

wherein the horizontal adjustment device further comprises a mounting seat horizontally fixed to a top of the base and including a horizontal rail, wherein one end of the base plate is slideable relative to the rail and is capable of moving right and left along the horizontal rail to adjust the position of the string pulling device.

2. The racket stringing machine as claimed in claim 1, wherein a slide seat is fixed at the one end of the base plate and is slidably mounted to the horizontal rail.

3. The racket stringing machine as claimed in claim 2, wherein the slide seat is horizontally fixed to the one end of the base plate.

4. The racket stringing machine as claimed in claim 3, wherein the mounting seat includes two opposite lateral boards for positioning the horizontal rail.

5. The racket stringing machine as claimed in claim 1 further comprising a brake device fixed on the base for stopping the racket stringing machine from running.

6. The racket stringing machine as claimed in claim 5, wherein the brake device comprises a disc and a clamping device disposed on a top of a rotary shaft of the base, wherein the clamping device includes a notch for receiving the disc and is connected with two brake cables, one of the two brake cables extends to a hand switch on the top of the base and another of the two brake cables is connected to a foot switch under the base.

* * * * *